United States Patent [19]

Lutgen et al.

[11] 4,038,832

[45] Aug. 2, 1977

[54] LIQUEFIED GAS CONTAINER OF LARGE CAPACITY

[75] Inventors: Harold Michael Lutgen, Montgomery; Terrence E. Rezac, New Prague, both of Minn.

[73] Assignee: Beatrice Foods Co., Chicago, Ill.

[21] Appl. No.: 610,917

[22] Filed: Sept. 8, 1975

[51] Int. Cl.[2] ..... F17C 3/02

[52] U.S. Cl. ..... 62/45; 114/74 A; 220/9 LG; 220/14; 220/15; 285/47

[58] Field of Search ..... 220/9 LG, 14, 15; 62/45, 54, 383; 114/74 A; 285/47

[56] References Cited

U.S. PATENT DOCUMENTS

| | | | |
|---|---|---|---|
| 1,598,149 | 8/1926 | Mott | 220/9 LG |
| 2,959,318 | 11/1960 | Clark et al. | 220/15 |
| 3,139,206 | 6/1964 | Matsch | 220/9 LG |
| 3,178,897 | 4/1965 | Carney | 62/45 |
| 3,347,056 | 10/1967 | Lester | 62/45 |
| 3,380,611 | 4/1968 | Brougham et al. | 220/15 |
| 3,698,200 | 10/1972 | Johnson et al. | 62/45 |
| 3,782,128 | 1/1974 | Hampton et al. | 220/15 X |
| 3,839,981 | 10/1974 | Gilles | 114/74 A |
| 3,866,785 | 2/1975 | Conte | 220/14 |

*Primary Examiner*—Ronald C. Capossela
*Attorney, Agent, or Firm*—McDougall, Hersh & Scott

[57] ABSTRACT

A container for low boiling liquefied gas formed of an inner and outer vessel spaced one from the other to provide an insulated space in between with the inner vessel being of cylindrical shape with the elongate axis horizontally disposed and means for supporting the inner vessel from the outer vessel by interconnection along the horizontal axis and in a manner to prevent relative rotational movement while permitting movement of the inner vessel relative to the outer vessel in the axial direction in response to expansions and contractions due to temperature change.

7 Claims, 3 Drawing Figures

FIG. 1
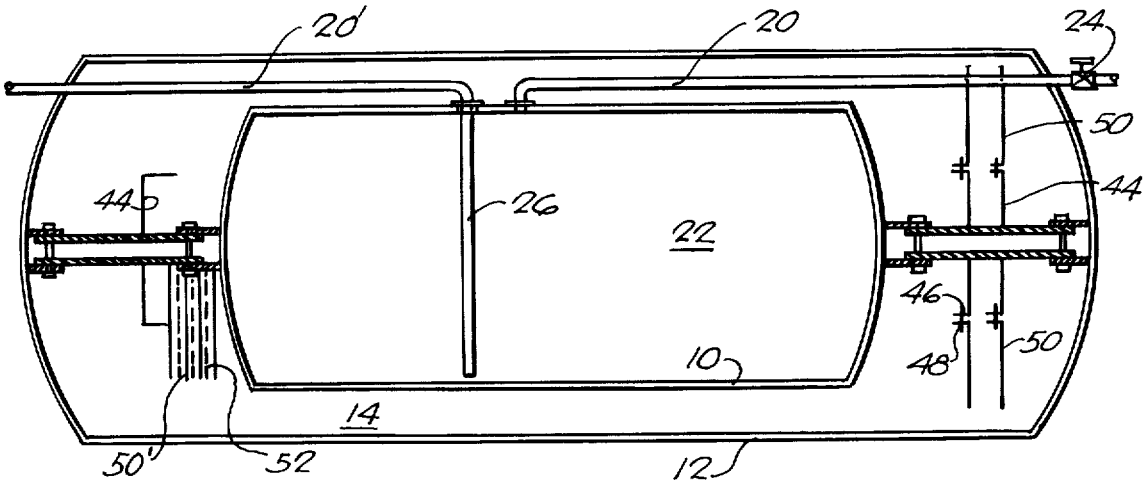
FIG. 2
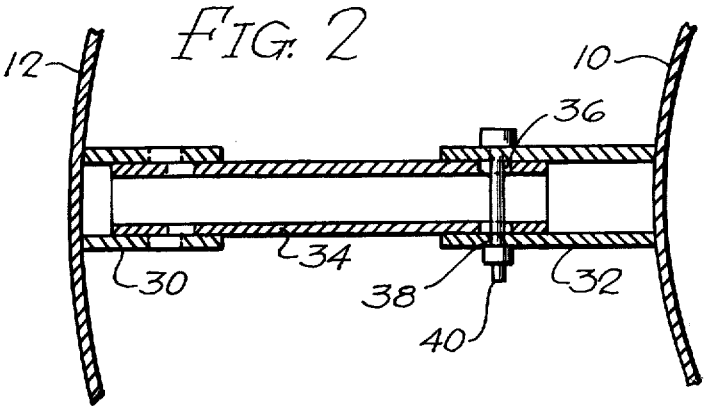
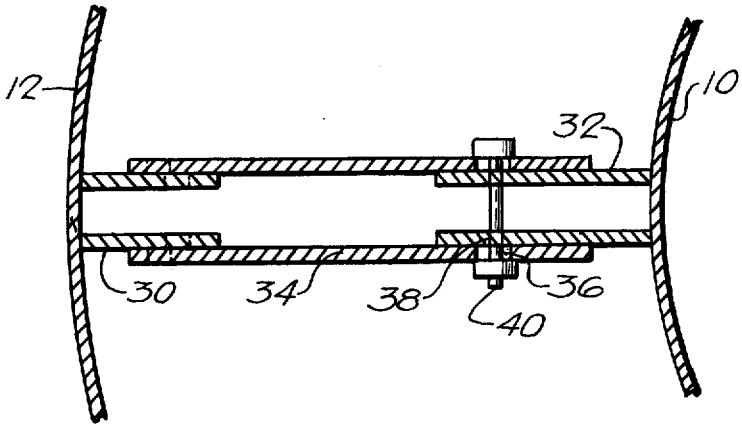
FIG. 3

LIQUEFIED GAS CONTAINER OF LARGE CAPACITY

This invention relates to an insulated, double walled container of large capacity for the storage of a liquefied gas, such as helium, argon, nitrogen, oxygen and the like low boiling liquefied gases. outer Double walled containers for storage and transportation of such liquefied gases have heretofore been produced wherein use is made of an inner container formed of aluminum, nickel steel and the like metallic materials which retain their strength at the low temperature of the liquefied gas adapted to be housed therein. The inner container is surrounded with an outer container that is spaced from the inner container to provide an intervening space which is evacuated and/or filled with insulating material such as powders, insulating fibers and the like, to minimize heat in-leak from the outside atmosphere. As described in the Matsch U.S. Pat. Nos. 3,007,596, 3,009,600 and 3,009,601, the evacuated space if filled with an insulation system formed of a multiplicity of layers of thin fabrics formed of fine fibers of glass, cellulose or other material characterized by low conductivity, with the layers being interleaved with reflective barrier sheets having a thickness of less than 0.001 inch and preferably about 0.0002 to 0.0003 inch, with the barrier sheets being formed of a highly reflective, heat conductive material, such as a metal film or a metallized plastic film.

The inner container is supported within the insulated space by means of a neck tube which communicates the interior of the inner container with an opening through the outer container for filling and emptying the container with the liquefied gas and for venting the boil-off from within the inner container to the atmosphere.

While such containers are suitable for use as containers of low capacity, such as a few gallons or less, the support is entirely inadequate for use in containers for the storage of liquefied gas in quantities as large as 500 or more gallon capacity and particularly for the storage of a liquefied gas, such as helium, argon or nitrogen, in volumes of 1,000 to 10,000 gallons or more.

Thus it is an object of this invention to provide a double walled container of large capacity which makes use of an insulation system of the type described, in which the amount of heat in-leak is minimized to reduce the amount of boil-off of the liquefied gas housed within the container, and in which the inner container is supported in a manner to permit the necessary expansions and contractions of the container without detracting from the support or stability of the container.

These and other objects and advantages of this invention will hereinafter appear, and for purposes of illustration, but not of limitation, an embodiment of the invention is shown in the accompanying drawing in which FIG. 1 is a schematic sectional elevational view of a container f large capacity for housing a liquefied gas in accordance with the practice of this invention;

FIG. 2 is an enlarged detailed view of an end section of the container which illustrates the means for support to enable relative axial movement in response to expansion and contraction while militating against relative rotational movement; and FIG. 3 is a modification of FIG. 2.

Referring now to the drawing, where like numerals represent like parts, the insulated container of large capacity comprises an inner vessel 10, preferably of cylindrical or elliptical shape, and an outer vessel 12, preferably though not necessarily of a shape corresponding to the inner vessel 10. The walls of the outer vessel 12 are spaced from the walls of the inner vessel 10 all around to provide an insulating space 14 in between.

The inner vessel 10, preferably formed of a metal that retains its strength under the low temperature of the liquefied gas adapted to be housed therein, such as liquefied helium, argon, nitrogen, oxygen, methane and the like, is dimensioned to have a length greater than its diameter (or maximum cross-sectional dimension if an elliptical vessel) with the inner vessel disposed with its axis or major dimension extending in the horizontal direction. A tubular member 20 extends through the top of the cylindrical vessel 10 for communication with the interior 22 of the vessel for removal of boil-off and a valve 24 is provided in the portion of the boil-off tube 20 for opening and closing the tube as desired for control of pressure within the vessel 10.

Another tubular member 26 extends down into the inner vessel 10 for use in the introduction and removal of liquefied gas.

Means are provided for supporting the inner vessel 10 from the outer vessel 12 in a manner which permits change in dimension of the inner vessel relative to the outer vessel, by reason of expansions and contractions due to wide changes in temperature, without in any way interfering with the stability of the inner vessel 10 or its support.

This is achieved, in accordance with the practice of this invention, by providing a pair of short tubular members, in the form of sleeve sections 30 and 32, aligned one with the other in spaced apart relation along the axis of the vessel with one sleeve section 32 secured to the end wall of the inner vessel 10 to extend outwardly therefrom, while the other sleeve section 30 is secured in axial alignment to extend inwardly from the corresponding end wall of the outer vessel 12, with the free ends of the axially aligned sleeve sections spaced one from the other.

The sleeve sections are interconnected by an elongate tubular member 34 which is dimensioned to be received in telescoping relation within or about the free end portions of the axially aligned sleeve sections 30 and 32. At least one of the telescoped portions of the tubular member is provided with diametrically spaced, elongate slots 36 adapted to be aligned with openings 38 through the sleeve section to enable a pin 40 to be inserted therethrough with the width of the slots 36 corresponding to the cross-sectional dimension of the pin 40 to militrate against relative rotational movement between the sleeve section and the tubular member, but with the slots 36 being dimensioned to have a length greater than the dimensional change calculated to take place between the inner and outer vessels. Thus support of the inner vessel is transmitted from the outer vessel through the interconnected sleeve sections and tubular member while permitting axial movement of the inner vessel relative to the outer vessel in response to dimensional change and preventing relative rotational movement.

The other end of the inner vessel can be supported from the outer vessel by a single axially aligned tubular member interconnecting the two vessels but in order more evenly to distribute the axial movement of the inner vessel relative to the outer vessel, it is preferred to repeat the supporting connection described above for support of the inner vessel at the other end. This also facilitates assembly and disassembly of the container in the event of change or repair.

It will be understood, by way of modification, that the tubular interconnecting member 34 may be formed with an inner diameter which is larger than the external diameters of the sleeve members for telescoping the tubular member onto the ends of the sleeve sections and that the elongate slots may be provided in the sleeve sections instead of or in addition to the slotted portions in the tubular member with the diametrically opposed openings in the other member to enable the locking pin to extend therethrough in a manner to militate against relative rotational movement while permitting axial sliding movement.

It will also be apparent that slotted portions can be provided in both of the sleeve sections 30 and 32 and/or in the opposite end portion of the tubular member 34 with the result that the length of the slots can be considerably shortened, but with the total length greater than the calculated change in dimension of the inner vessel relative to the outer vessel in the axial direction. Similarly, the tubular connection at the other end can also be provided with slots in one member and openings in the other member for enabling interconnecting pins to extend therethrough whereby the length of the slots can correspondingly be decreased but with the total of the lengths of the slots at each end greater than the dimensional change calculated to take place in the axial direction between the inner and outer vessels.

To minimize heat loss through the support, means are provided for transfer of energy from the boil-off to the support. For this purpose, as schematically illustrated in FIG. 1 of the drawing, a plurality of ring members 44, formed of a metal or other high heat conductive material, are joined in axially spaced apart relation and in heat conductive relation to the support, including the sleeve sections 30 and 32 and/or the telescoping tubular member 34. When the ring members 44 are formed of a highly conductive metal, such as copper or aluminum, the ring members can be spun onto the tubular member or sleeve sections or the ring members 44 can be provided in the form of metal discs having a central opening corresponding to the outer wall-to-wall dimension of the tubular members or sleeve sections for attachment thereto, as by conventional metal bonding means such as soldering or braising.

The ring members are formed with an annular flanged portion 46 which extends substantially perpendicularly from their outer periphery with openings in the flanged portions for attachment, as by means of rivets, or by means of a nut and bolt assembly through openings in a corresponding flanged portion 48 of connecting strips 50 connected in heat transfer relationship to spaced portions of the tubular member 20 through which the boil-off is vented.

In assembly, the sleeve sections 30 and 32 , with the ring members 44 thereon, are pre-wound, as by spiral winding, with the desired number of layers 50'of heat insulating material, such as thin webs of glass fibers having a diameter less than 20 microns and preferably less than 10 microns, and intermediate layers of heat reflective barrier strips 52 of the type previously described. As the layers of insulation and barrier strips reach a ring member, a connecting strip 50 is attached to the ring member and the boil-off tube and then the winding of the insulation layers and reflective barrier strips is continued until insulation sufficient to fill the insulated space is applied onto the outer walls of the inner vessel. The insulated vessel can then be inserted axially through an open end of the outer container with the sleeve sections telescoped onto or into the tubular member at one end, after which the end wall for the open end is fitted to complete the outer vessel with the sleeve sections engaged in telescoping relation with the tubular member in axial alignment therewith.

For containers of still larger capacity, such as more than 5,000 gallon capacity, an auxiliary boil-off tube 20' can be provided to extend in a direction opposite to the boil-off tube 20 and the additional boil-off tube can be connected by connecting strips and ring members of the type described to establish a heat conductive relationship from the support at the opposite end to the boil-off tube 20' thereby to utilize the energy of the boil-off to cool the support and thus minimize heat loss therethrough.

It will be understood that the inner vessel is constructed of a metal which retains its strength under the low temperature conditions of the liquefied gas adapted to be contained therein. For this purpose, the inner vessel may be formed of aluminum, high nickel steel and the like type of structural metals.

It will also be understood that the inner and outer vessels may be formed of other than circular shape in cross-section but a circular contour is desired for maximun strength and utilization of space and to provide for greater freedom of movement of the inner container relative to the outer container responsive to the wide change in temperature from the high temperature of the empty container to the lower temperature of the container when filled with the liquefied gas and that the invention is applicable to inner and outer vessels of the type described in which the insulation space in between is merely an evacuated space and/or filled with powders, fibers or other insulating material.

It will be understood that changes may be made in the details of construction, arrangement and operation without departing from the spirit of the invention, especially as defined in the following claims.

We claim:

1. A low boiling liquefied gas container of large capacity comprising an inner vessel having a length of considerably greater dimension that its width with the vessel being disposed with the major dimension extending in the horizontal direction, an outer vessel surrounding the inner vessel and spaced therefrom to provide an intervening insulated space, conduit means between the outer vessel and the upper portion of the interior of the inner vessel for the removal of boil-off from within the inner vessel and for the introduction and removal of liquefied gas, means for supporting the inner vessel from the outer vessel in a manner to prevent rotational movement of the inner vessel relative to the outer vessel about a horizontal axis while permitting movement of the inner vessel relative to the outer vessel in the horizontal direction in response to expansions and contractions of the inner vessel relative to the outer vessel due to temperature change in which the means for support comprises cylindrical members interconnecting the adjacent end walls of the inner and outer vessels along the horizontal axis and engaged in telescoping relation with each other, said means for supporting the inner vessel from the outer vessel providing the entire support for the inner vessel and for stabilizing the inner vessel within the outer vessel.

2. A container as claimed in claim 1 in which the interconnecting means comprises a pair of tubular members in which one member of the pair extends outwardly from the end walls of the inner vessel in axial alignment with the other member of the pair extending inwardly from the end walls of the outer vessel, and means interconnecting the tubular members in telescoping relation in a manner to prevent relative rotational movement while permitting relative endwise movement.

3. A container as claimed in claim 2 which includes at least one axially extending elongate slot in one of the telescoped portions of one of the tubular members and openings in the other in registry with the slot and a pin extending through the openings into the slot to prevent relative rotational movement while permitting relative axial movement.

4. A container as claimed in claim 3 in which the total length of the slot or slots is dimensioned to be greater than the maximum dimensional change calculated to take place between the inner and outer vessels.

5. A container as claimed in claim 4 in which the free ends of the axially aligned tubular members are spaced one from the other and which includes an elongate sleeve between the tubular members of the pair with the opposite end portions of the sleeve in telescoping engagement with said tubular members.

6. A container as claimed in claim 5 in which at least one of the telescoped portions of the sleeve and tubular member contains an elongate axially aligned slot with openings in the other in radial alignment with the slot and a means extending through the opening into the slot for interengagement between the sleeve and tubular member in a manner to prevent rotational movement while permitting relative axial movement therebetween.

7. A low boiling liquefied gas container as claimed in claim 1 which includes metal conductor means of high heat conductivity interconnecting the boil-off conduit with the laterally extending support means for transfer of heat from the support to the boil-off conduit.

* * * * *